US008390604B2

(12) United States Patent
Ryu

(10) Patent No.: US 8,390,604 B2
(45) Date of Patent: Mar. 5, 2013

(54) DIFFERENTIAL SIGNALING SYSTEM AND FLAT PANEL DISPLAY WITH THE SAME

(75) Inventor: Jee-youl Ryu, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 813 days.

(21) Appl. No.: 11/972,194

(22) Filed: Jan. 10, 2008

(65) Prior Publication Data

US 2008/0170063 A1 Jul. 17, 2008

(30) Foreign Application Priority Data

Jan. 11, 2007 (KR) ..... 10-2007-0003362

(51) Int. Cl.
*G09G 5/00* (2006.01)

(52) U.S. Cl. ..... 345/204

(58) Field of Classification Search ..... 345/55, 345/204–214, 99; 326/82–87
See application file for complete search history.

(56) References Cited

U.S. PATENT DOCUMENTS

| | | | | |
|---|---|---|---|---|
| 6,448,813 | B2 | 9/2002 | Garlepp et al. | |
| 6,448,815 | B1 * | 9/2002 | Talbot et al. | 326/86 |
| 6,856,309 | B2 * | 2/2005 | Chang et al. | 345/100 |
| 6,894,436 | B2 * | 5/2005 | Togashi et al. | 315/169.4 |
| 6,992,508 | B2 * | 1/2006 | Chow | 326/86 |
| 7,067,743 | B2 | 6/2006 | Tsukashima | |
| 7,236,018 | B1 * | 6/2007 | Wang et al. | 327/108 |
| 7,595,661 | B2 * | 9/2009 | Kim | 326/82 |
| 7,598,772 | B2 | 10/2009 | Young | |
| 7,633,312 | B2 * | 12/2009 | Saeki | 326/83 |
| 2004/0104903 | A1 * | 6/2004 | You | 345/204 |
| 2005/0007393 | A1 * | 1/2005 | Akai et al. | 345/690 |
| 2005/0239431 | A1 * | 10/2005 | Yamamoto et al. | 455/333 |
| 2006/0071683 | A1 * | 4/2006 | Best et al. | 326/30 |

FOREIGN PATENT DOCUMENTS

| | | |
|---|---|---|
| JP | 05-55898 | 3/1993 |
| JP | 9-102763 | 4/1997 |
| JP | 10-290183 | 10/1998 |
| JP | 2004-112178 | 4/2004 |
| KR | 1999-0066886 | 8/1999 |
| KR | 2000-0074847 A | 12/2000 |
| KR | 2005-0113476 A | 12/2005 |

OTHER PUBLICATIONS

Notice of Allowance issued in corresponding Korean Patent Application No. 2007-0003362 dated Dec. 21, 2007.
Korean Office Action dated Oct. 26, 2007 for Korean Patent Application No. 10-2007-0003361 corresponding to U.S. Appl. No. 11/971,408, filed Jan. 9, 2008, which is related to above-captioned U.S. Appl. No. 11/972,194.

* cited by examiner

*Primary Examiner* — Chanh Nguyen
*Assistant Examiner* — Pegeman Karimi
(74) *Attorney, Agent, or Firm* — Knobbe Martens Olson & Bear LLP

(57) ABSTRACT

A differential signaling system and a flat panel display using the same. The differential signaling system includes a first wiring and a second wiring connected to a sending end and a receiving end as a differential signal line; a termination resistor connected between the first wiring and the second wiring in the receiving end side; and a programmable compensation circuit connected to the termination resistor in parallel. The programmable compensation circuits includes n switches to receive each bit of an input digital control signal; first resistors connected between a source electrode of each of the switches and the first wiring; and second resistors connected between a drain electrode of each of the switches and the second wiring.

21 Claims, 6 Drawing Sheets

DIFFERENTIAL SIGNALING SYSTEM AND FLAT PANEL DISPLAY WITH THE SAME

CROSS-REFERENCE TO RELATED APPLICATION

This application claims the benefit of Korean Patent Application No. 2007-3362, filed on Jan. 11, 2007 in the Korean Intellectual Property Office, the disclosure of which is incorporated herein by reference.

BACKGROUND OF THE INVENTION

1. Field of the Invention

Aspects of the present invention relate to a flat panel display using a signal transmission method for transmitting a differential signal, and more particularly, to a flat panel display including a differential signaling system for an impedance matching in the signal transmission method.

2. Description of the Related Art

The cathode ray tube (CRT) is a widely used type of display device. The CRT has been used as a monitor for a television, a measuring instrument, or an information terminal. Due to limits on weight and size, CRT display devices are becoming unsuitable for an era where miniaturization and low weight requirements are essential.

Accordingly, various flat panel displays, such as a liquid crystal display (LCD), a plasma display panel (PDP), a field emission display (FED), and an organic light emitting display (OLED), have been studied and developed as substitutes for the CRT. These displays have advantages in light of miniaturization, light-weight, and low electric power consumption requirements, as compared to the CRT.

The flat panel display includes various components and wirings for transmitting signals between the components. Recently, with the development of electronic circuit and manufacturing process technology, signals can be transmitted through the wirings at high speed. These high speed signal transmission requirements lead to a requirement for a higher drive speed of the components.

Accordingly, various methods for transmitting signals between the components through wirings have been suggested, including a signal transmission method such as low voltage differential signal (LVDS) method or a reduced swing differential signaling (RSDS) method for transmitting a differential signal.

A differential signaling system transmits a different mode signal having the same amplitude and a different polarity through a differential transmission line. Accordingly, there is a tendency to remove a concentrated magnetic field and to couple an electric field. A high speed signal can be stably transmitted without a signal reflection or a skew (phase delay) electro magnetic interference (EMI) due to the coupled electric field.

A conventional flat panel display will be described with reference to the accompanying drawings. FIG. 1 is a block diagram showing a construction of a conventional flat panel display. The conventional flat panel display includes a display panel 40, a gate driver 20, a data driver 30, and a controller 10. Pixels are arranged at the display panel 40 in the matrix. The gate driver 20 sequentially applies a scan signal to gate wirings of the display panel 40. The data driver 30 applies an image signal DATA1 to data wirings of the display panel 40. The controller 10 applies the image signal DATA1 from an external graphic controller (not shown) to the data driver 30, and applies a control signal CS1 to the gate driver 20 and the data driver 30 in order to control a drive timing.

In the conventional flat panel display, after all gate wirings of the display panel 40 are sequentially scanned and the image signal DATA1 is applied to pixels through the data wirings to display one frame of an image, a vertical synchronous signal VSYNC is applied to display a next frame of the image.

FIG. 2 is a block diagram showing the controller and the data driver shown in FIG. 1 in detail. FIG. 3 is a view showing a signal transmission method between the controller and the data driver. As shown in FIG. 2, the data driver 130 is composed of a plurality of data driving circuits 132. The plurality of data driving circuits 132 receive image signals DATA [+,−] from the controller 110 through first and second wirings W1 and W2, and receive a control signal CS11 from the controller 110 through a third wiring W3.

The data driver 130 includes a plurality of data driving circuits 132 therein. The data driving circuits 132 receive image signals DATA [+,−] from the controller 110, and output the signals to the data wirings according to the control signal CS11 from the controller 110. A plurality of data wirings (not shown) are electrically coupled to the data driving circuits 132, and apply the image signals DATA [+,−] applied to the data driving circuits 132 to the pixels.

The image signal from the controller is transmitted to the respective data driving circuits in the aforementioned differential signal transmission method. As shown in FIG. 3, in order to transmit one data group DATA [+,−], a differential transmission line arrangement, namely, first and second wirings W1 and W2, are provided between the controller 110 (a sending end Tx) and the data driving circuit 132 (a receiving end Rx). A termination resistor $R_t$ is installed between differential transmission lines of the receiving end (data driving circuit 132) side. The termination resistor $R_t$ electrically connects the first wiring W1 and the second wiring W2 to each other, which are connected to each data driving circuit 132.

The image signal DATA [+] applied through the first wiring W1 is transferred to the controller 110 through the termination resistor $R_t$ and the second wiring W2. The termination resistor $R_t$ prevents excessive current from flowing to the data driving circuit 132. A voltage across the termination resistor $R_t$ is image signal DATA [+,−], and is applied to the data driving circuit 132.

A plurality of electric devices and wirings are provided in the flat panel display, and are electrically coupled to each other. Since the electric devices and wirings have an impedance component, the signal is attenuated during a signal transmission between the electric devices.

The controller 110 and the data driving circuits 132 have an impedance component. The first and second wirings W1 and W2 connecting the controller 110 and the data driving circuits 132 have an impedance component Z0. If the impedance value Z0 of the first wirings W1 and W2 is different from that of the data driving circuits 132, namely, when an impedance mismatching occurs, the image signals DATA[+,−] are not supplied to the data driving circuits 132 correctly. A part of the image signals is reflected and discharged.

A reflection coefficient ⌈ is expressed by the following equation 1.

$$\Gamma = \frac{Z_{diff} - R_t}{Z_{diff} + R_t} \tag{1}$$

where a differential impedance $Z_{diff}$ is a value less than 2Z0 and is a sum of impedance values of the first and second wirings, and has a different value according to a manufacturing process variable and a construction of the flat panel display.

When the differential impedance $Z_{diff}$ is identical with a value of the termination resistor, a reflection loss of a signal does not occur. However, the differential impedance $Z_{diff}$ varies. Accordingly, in the conventional case, the impedance matching is not normally achieved in the differential transmission method.

When a reflection wave occurs due to an impedance mismatching, an interference with the image signals DATA [+,−] applied through the first wiring W1 occurs to cause unstable wave, signal distortion, and attenuation. The electro magnetic interference (EMI) reduces image quality of the flat panel display.

SUMMARY OF THE INVENTION

Aspects of the present invention provide a differential signaling system and a flat panel display, which clearly perform an impedance matching without an electro magnetic interference in order to stably transmit a high speed signal by compensating a variation of a differential impedance by a programmable compensation circuit in a flat panel display using a signal transmission method for transmitting a differential signal in which the programmable compensation circuit is installed inside the data driving circuit (a receiving end) and performs an impedance matching in a differential signal transmission method.

According to an aspect of the present invention, a differential signaling system is provided. The differential signaling system comprises a first wiring and a second wiring connected to a sending end and a receiving end as a differential signal line; a termination resistor connected between the first wiring and the second wiring in the receiving end side; and a programmable compensation circuit connected to the termination resistor in parallel, including a plurality of switches to receive each bit of an input digital control signal, first resistors connected between a source electrode of each of the switches and a first wiring; and second resistors connected between a drain electrode of each of the switches and a second wiring.

According to another aspect of the present invention, a flat panel display is provided. The flat panel display comprises a display panel having a plurality of data wirings and gate wirings arranged to intersect each other; a controller to receive an image signal, to generate a control signal, and to output the image signal and the control signal through the first and second wirings as a differential signal line; a gate driver to receive the control signal from the controller and to apply a scan signal to the gate wirings; and a plurality of data driving circuits, each including a programmable compensation circuit connected to a terminal resistor in parallel installed between the first and second wirings, to automatically control an impedance value of the data driving circuit corresponding to a differential impedance value by the differential signal line, each of the data driving circuits including a data driver to receive the image signal and/or the control signal from the controller through the first and second wirings and to apply the image signal to the data wirings wherein the programmable compensation circuits includes a plurality of switches to receive each bit of an input digital control signal; first resistors connected between a source electrode of each of the switches and the first wiring; and second resistors connected between a drain electrode of each of the switches and the second wiring.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
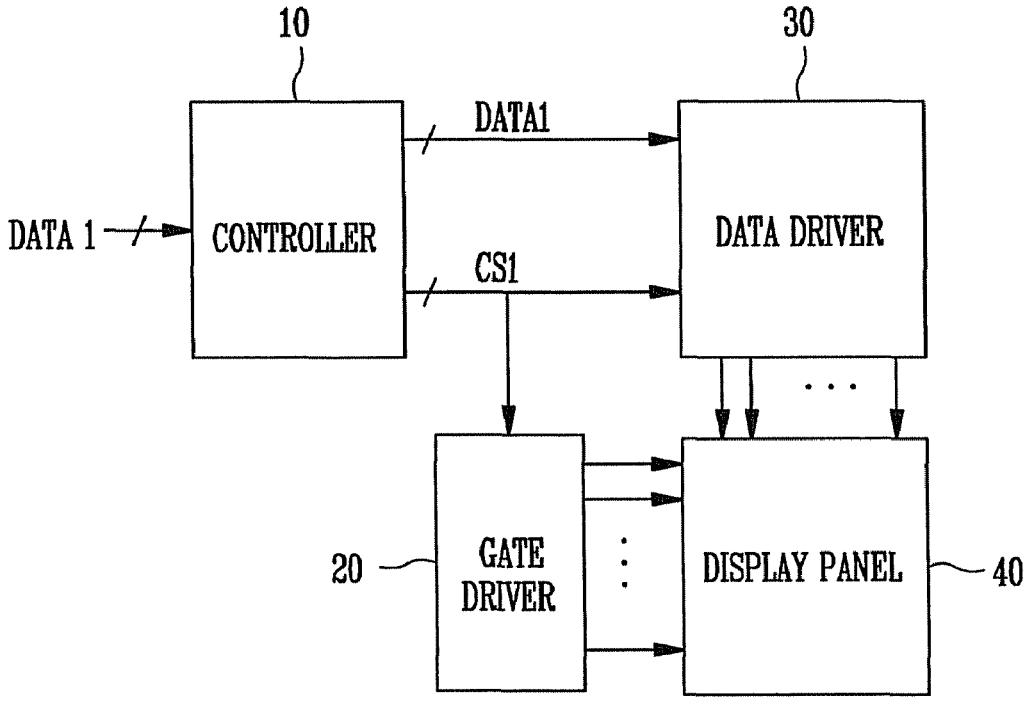
FIG. 1 (PRIOR ART)
FIG. 1 is a block diagram showing a construction of a conventional flat panel display.
Figure 2:
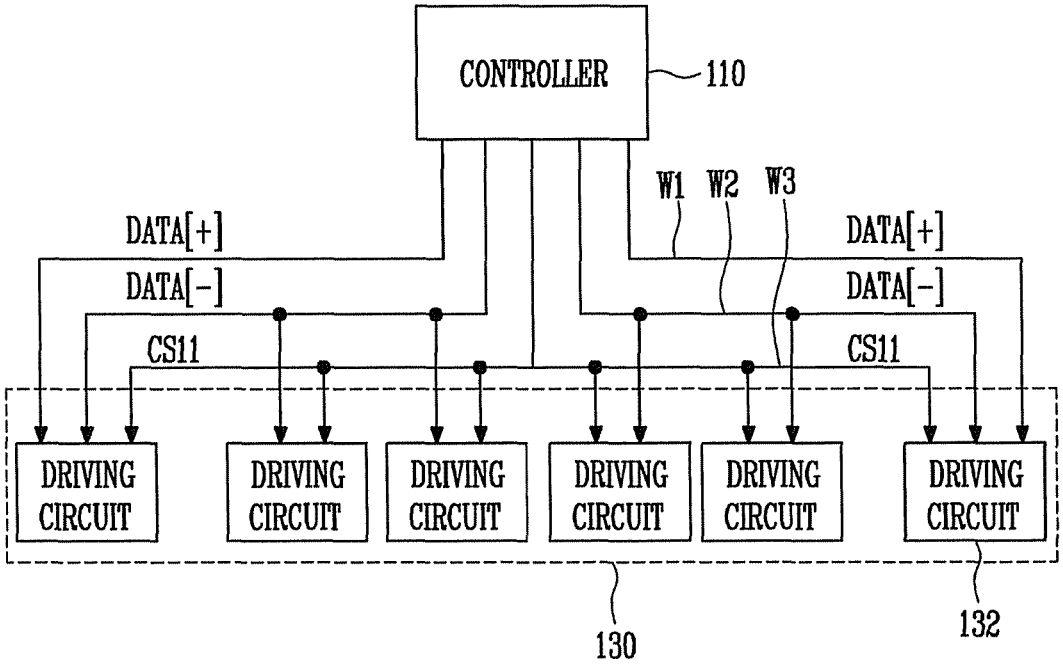
FIG. 2 (PRIOR ART)
FIG. 2 is a block diagram showing a controller and a data driver shown in FIG. 1 in detail.
Figure 3:
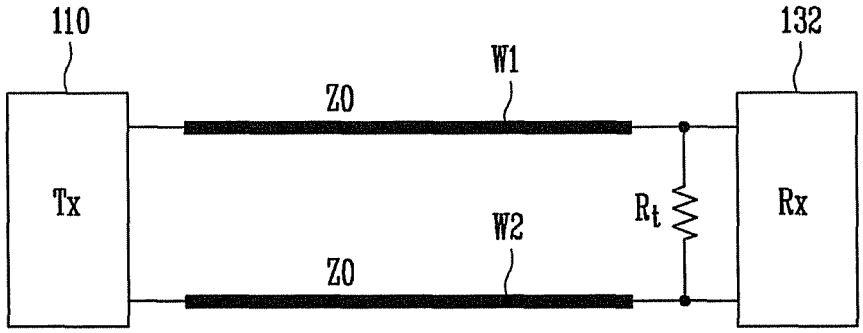
FIG. 3 (PRIOR ART)
FIG. 3 is a view showing a signal transmission method between the controller and the data driver.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
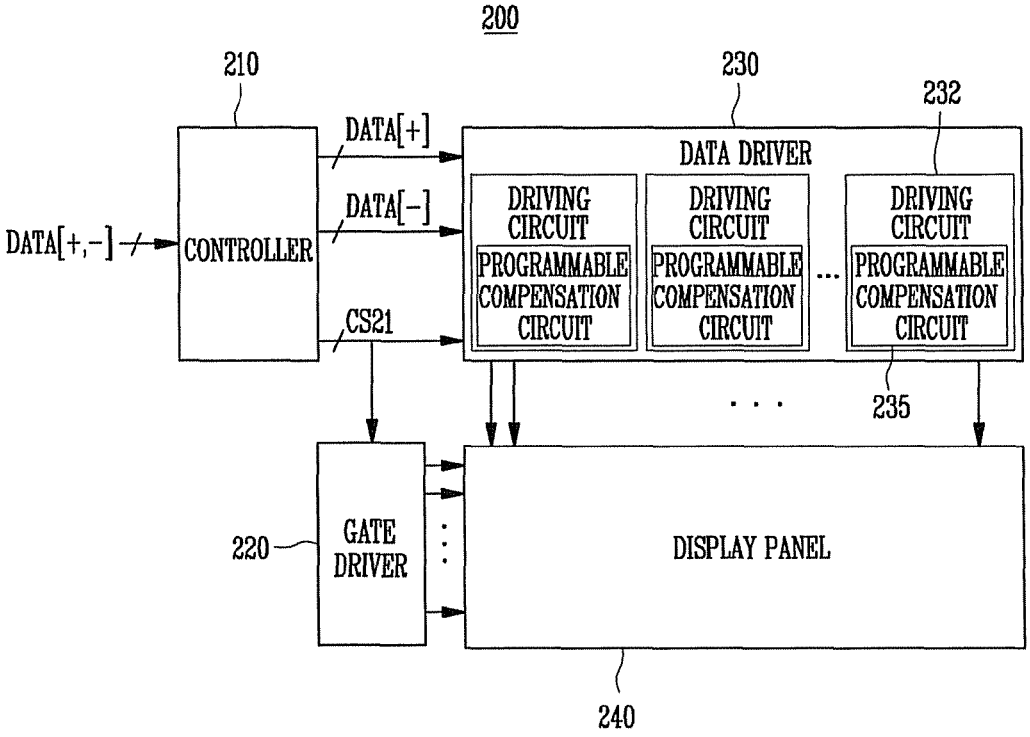
FIG. 4 is a block diagram showing a construction of a flat panel display according to an embodiment of the present invention.

FIG. 4 is a block diagram showing a construction of a flat panel display 200 according to an embodiment of the present invention. The flat panel display 200 includes a display panel 240, a gate driver 220, a data driver 230, and a controller 210. According to other aspects of the invention, the flat panel display 200 may include additional and/or or other components. Similarly, the functionality of two or more of the above components may be combined into a single unit.

Gate lines and data lines are arranged to intersect each other on the display panel 240. The gate driver 220 sequentially applies a scan signal to gate wirings of the display panel 240. The data driver 230 applies an image signal DATA [+,−] to data wirings of the display panel 240. The controller 210 applies the image signal DATA [+,−] from an external graphic controller (not shown) to the data driver 230, and applies a control signal CS21 to the gate driver 220 and the data driver 230 in order to control a drive timing.

The flat panel display 200 may be a flat panel display using a signal transmission method for transmitting a differential signal. A programmable compensation circuit 235 is installed inside the data driving circuit (a receiving end), and compensates a variation of a differential impedance in order to clearly perform an impedance matching.

In the display panel 240, a plurality of gate wirings are arranged so as to be spaced apart from each other in a transverse direction. A plurality of data wirings are arranged so as to be spaced apart from each other in a longitudinal direction. The gate wirings and the data wirings intersect each other to divide a plurality of regions. The regions are referred to as 'pixels'. The pixels are electrically coupled to the gate wirings and the data wirings, and are arranged on the display panel 240 in the matrix.

The controller 210 represents a timing controller. The controller 210 receives image signals DATA [+,−] and generates various control signals CS21 to drive the flat panel display 200. The controller 210 applies the image signals DATA [+,−] to the data driver 230, and applies the control signal CS21 to the gate driver 221 and the data driver 230 to control a drive timing. The controller 210 applies a vertical synchronous signal VSYNC, a horizontal synchronous signal HSYNC, a clock signal, a gate start signal, and a data output enable signal to the gate driver 220 and the data driver 230 as the control signal CS21 to control a drive timing of the gate driver 220 and the data driver 230.

The controller 210 applies the horizontal synchronous signal HSYNC and the gate start signal to the gate driver 220 to sequentially apply a scan signal to the gate wirings of the display panel 240. The controller 210 applies the horizontal synchronous signal HSYNC, the data output enable signal, and the image signals DATA [+,−] to the data driver 230, so that the image signals DATA [+,−] are applied to pixels of the gate wiring to which the scan signal is applied. This controls the drive timing of the gate driver 220 and the data driver 230.

The data driver 230 is electrically coupled to the display panel 240 through the data wirings. The data driver 230 is composed of a plurality of data driving circuits 230. Each of the data driving circuits 230 receives the image signals DATA [+,−] and the control signal CS21 from the controller 210, and outputs the image signals to the data wirings.

The programmable compensation circuit 235 is installed at input terminals of each data driving circuit 232. The data driving circuit 232 receives the image signals DATA [+,−] from the controller 210. A differential impedance from the controller 210 to the data driving circuit 232 and an impedance of the data driving circuit 232 are equally matched so that the image signals DATA [+,−] from the controller 210 are easily supplied. The gate driver 220 receives a control signal CS21 from the controller 210, and sequentially applies a scan signal to the gate wirings to drive pixels arranged in the matrix in gate wirings. The data driver 230 applies the image signals DATA [+,−] to the pixels to which the scan signal is applied through the data wirings.

Through the aforementioned operation, after all gate wirings of the display panel 240 are sequentially scanned and the image signals DATA [+,−] are applied to the pixels through the data wirings to display one frame of an image, the vertical synchronous signal VSYNC is applied to display a next frame of the frame.

Figure 5:
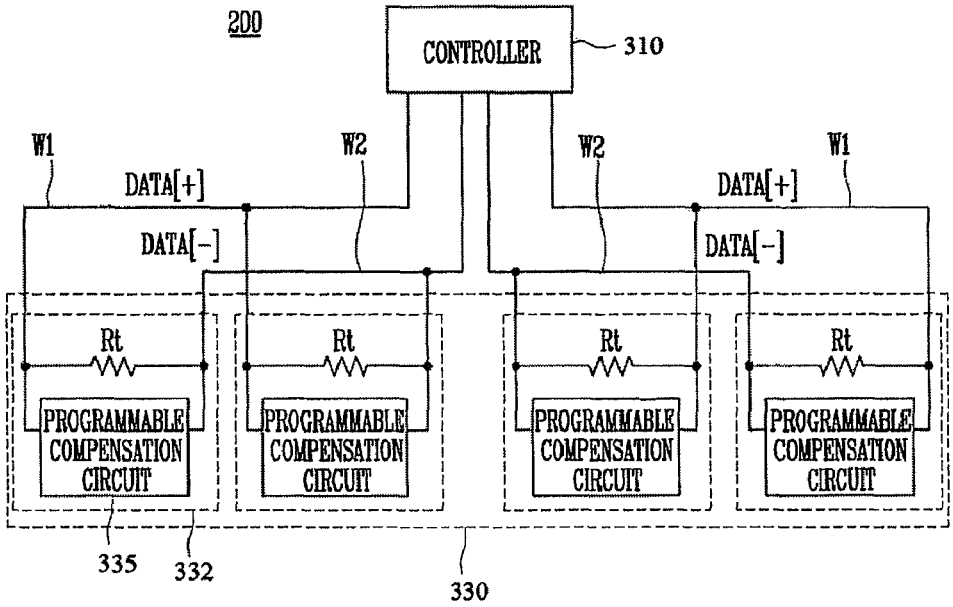
FIG. 5 is a detailed view showing an example of the controller and the data driver shown in FIG. 4.
Figure 6:
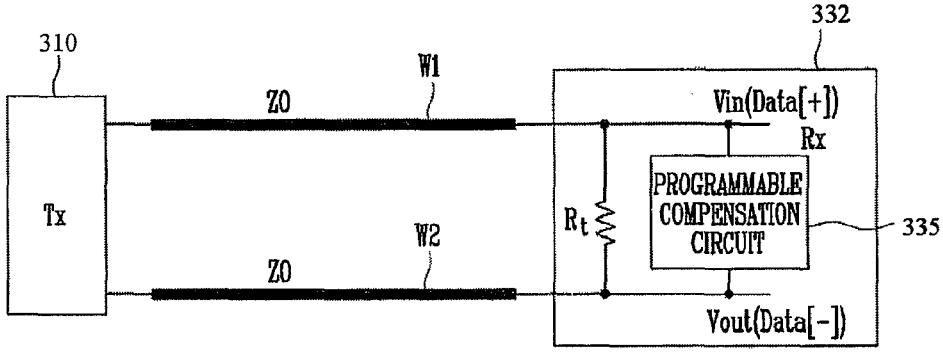
FIG. 6 is a block diagram showing a differential signaling system according to an embodiment of the present invention.
Figure 7:
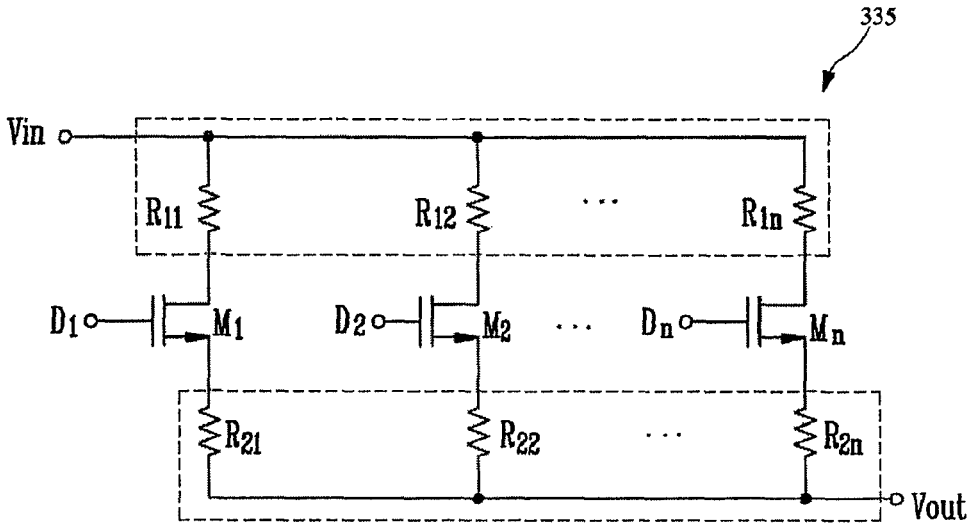
FIG. 7 is a detailed circuitry diagram of an programmable compensation circuit.

FIG. 5 is a detailed view showing an example of the controller and the data driver shown in FIG. 4. FIG. 6 is a block diagram showing a differential signaling system according to an embodiment of the present invention. FIG. 6 is a view illustrating a signal transmission method between the controller and the data driver shown in FIG. 5. FIG. 7 is a detailed circuitry diagram of a programmable compensation circuit.

As shown in FIG. 5, the flat panel display 200 includes a controller 310 and a data driver 330. The controller 310 receives the image signals DATA [+,−] from an exterior and applies them to the first and second wirings W1 and W2. The data driver 330 includes a plurality of data driving circuits 332. The plurality of data driving circuits 332 match an impedance with the exterior, and receive the image signals DATA [+,−] from the controller 310 through the first and second wirings W1 and W2.

The controller 310 and the data driving circuits 332 transmit the image signals and the control signal, for example, by a low voltage differential signaling (LVDS) transmission method, which transmits signals at high speed. The controller 310 is electrically connected to the data driver 330 through the first and second wirings W1 and W2. The data driver 330 includes the plurality of data driving circuits 332. Each of the data driving circuits 332 receives the image signals DATA [+,−] from the controller 310 through the first and second wirings W1 and W2. However, for convenience of description, wiring for supplying a control signal is omitted in FIG. 5. A pair of first and second wirings W1 and W2 is connected to each data driving circuit 332. In practice, plural pairs of the first and second wirings W1 and W2 may be connected to each data driving circuit 332.

The first and second wirings W1 and W2 are connected to the data driving circuit 332. The first and second wirings W1 and W2 are electrically connected through a termination resistor $R_t$ to form a closed circuit. The image signals DATA [+,−] applied from the controller 310 are applied to the terminal resistor $R_t$ as a voltage. The terminal resistor $R_t$ prevents an excessive current from flowing in the data driving circuit 332, and applies a constant voltage indicating the image signals DATA [+,−] to the data driving circuit 332.

As shown in FIG. 6, in order to transmit one data group DATA [+,−], a differential transmission line arrangement, namely, first and second wirings W1 and W2, are provided between the controller 310 (a sending end Tx) and the data driving circuit 332 (a receiving end Rx). A termination resistor $R_t$ is provided between the differential transmission lines of the data driving circuit being the receiving end. The termination resistor $R_t$ electrically connects the first and second wirings W1 and W2 connected to each data driving circuit 132 to form a closed circuit.

As described earlier, when only the termination resistor $R_t$ is connected between the differential transmission lines, since the differential impedance $Z_{diff}$ can vary due to external factors, the impedance matching is normally achieved in the differential transmission method. So as to solve the problems described above, the programmable compensating circuit 335 is connected to the termination resistor $R_t$ in parallel. Through the programmable compensating circuit 335, an impedance value of a receiving end, namely, the data driving circuit corresponding to the differential impedance value, is automatically controlled, and more exact impedance matching can be obtained.

A reflection coefficient ⌈ in a system including the programmable compensation circuit 335, namely, a differential signaling system according to an embodiment of the present invention shown in FIG. 6 may be expressed by equation 2.

$$\Gamma = \frac{\overline{Z_{diff}} - Z_{TN}}{\overline{Z_{diff}} + Z_{TN}} \tag{2}$$

where $\overline{Z_{diff}}$ is a changeable differential impedance and $Z_{TN}$ is a parallel composite impedance.

The parallel composite impedance $Z_{TN}$ may be expressed by equation 3.

$$Z_{TN} = R_t \,//\, Z_{PCC} = R_t \,//\, \frac{N}{M} R_b = \frac{R_t}{1 + \frac{M}{N}\left(\frac{R_t}{R_b}\right)} \tag{3}$$

where $R_t$ represents a terminal resistance and $Z_{PCC}$ represents a total composite resistance of the programmable compensation circuit 335. $R_b$ represents a resistance value of a resistor included in the programmable compensation circuit 335, N represents the bit number of a digital control signal inputted to the programmable compensation circuit 335, and M represents a logic high bit number of an input digital control signal.

The differential impedance is a value less than 2Z0 being a sum of impedance values of the first and second wirings. The differential impedance can change according to a manufacturing process variable and an arrangement of the flat panel display. As shown in equation 3, since the value of $Z_{TN}$ varies by an operation of the programmable compensation circuit, a variation of the differential impedance can be compensated. The programmable compensation circuit 335 operates so that the $Z_{TN}$ is equal to $\overline{Z_{diff}}$. The reflection coefficient thus becomes zero, thereby removing a reflection loss of a signal.

Since the programmable compensation circuit 335 is connected to the termination resistor $R_t$ in parallel, an exact impedance matching is embodied with a differential impedance value by the first and second wirings W1 and W2 coupled with the data driving circuit 332. Accordingly, the image signals DATA [+,−] applied through the first and second wirings W1 and W2 are not reflected, and an electro magnetic interference (EMI) applied to the data driving circuits 332 can be reduced (or eliminated). Since the image signals DATA [+,−] having a stable wave from the controller 310 are easily applied to the data driving circuit 332, deterioration of image quality of the flat panel display may be prevented.

A construction of the programmable compensation circuit 335 will be explained with reference to FIG. 7. As shown in FIG. 7, the programmable compensation circuit 335 includes n switches M1, M2, M3, . . . , Mn; first n resistors R11, R12, R13, . . . , R1*n*; and second n resistors R21, R22, R23, . . . , R2*n*. The n switches M1, M2, M3, . . . , Mn receive each bit of an input digital control signal. The first n resistors R11, R12, R13, . . . , R1*n* are connected between a source electrode of each switch and a first wiring W1 of a differential signal line. The second n resistors R21, R22, R23, . . . , R2*n* are connected between a drain electrode of each switch and a second wiring W2 of the differential signal line.

The number of switches indicates a digital bit number of a control signal for controlling the programmable compensation circuit. For example, when the programmable compensation circuit operates with 8 bits, n becomes 8. Although not required in all aspects, hereinafter, it is assumed that the programmable compensation circuit operates by an 8 bit control signal.

Each switch receives each bit of the input digital control signal and is turned on or off according to the received bit. The switch can be used as a transistor. The transistor may have a layout with a minimum distributed gate resistance so as to minimize an influence by a thermal noise. The transistor may also be designed to be operated in a deep triode region not to have any DC offset between input and output voltages.

Although not required in all aspects, resistances of the first n resistors R11, R12, R13, . . . , R1*n* and the second n resistors R21, R22, R23, . . . , R2*n* may have the same value, which is $(N/M)R_b$. As described above, $R_b$ represents a resistance value of a resistor included in the programmable compensation circuit 335. However, this is one embodiment, and the present invention is not limited thereto. In addition, N is a digital control signal bit number inputted to the programmable compensation circuit 335. M is a logic high bit number of an input digital control signal. According to an embodiment of the present invention, N is 8 and M is 2, though other values may be used as well. When the programmable compensation circuit operates with 8 bits, first eight resistors and second eight resistors are provided, and resistance values thereof are $(8/2)R_b$ and $4R_b$, respectively.

FIGS. 8A through 8D are views illustrating an operation of the programmable compensation circuit 335 shown in FIG. 7.

Figure 8A:
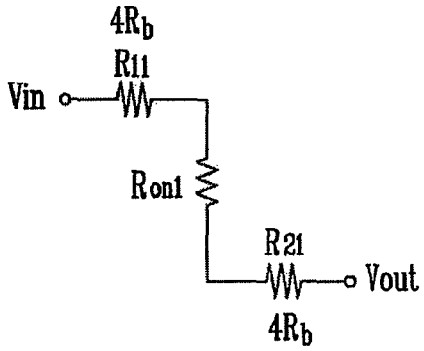
FIGS. 8A through 8D are views for illustrating an operation of the programmable compensation circuit shown in FIG. 7.

FIG. 8A shows an alternating current equivalent circuit when 8 bit control signals D8, D7, . . . , D1 inputted to the programmable compensation circuit are (0, 0, . . . , 1), namely, a state where only a switch M1 among the switches is turned on but remaining switches are turned off. The first resistor R11 and the second resistor R21 have a resistance of $4R_b$. It is assumed that a shown resistor Ron1 is a turn-on resistor of the switch M1, and has a very small value. Accordingly, a voltage dropped in the resistor Ron1 having a very small resistance value can be disregarded.

$$\text{Ron1}, \ldots, \text{Ron8} \ll 4R_b \tag{4}$$

Figure 8B:
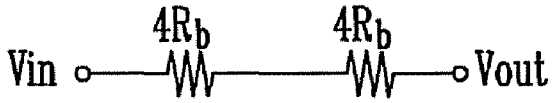
Figure 8C:
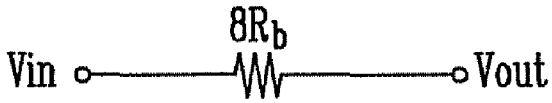

As a result, an alternating current equivalent circuit of FIG. 8A can be expressed by an equivalent circuit shown in FIG. 8B. As shown in FIG. 8C, the alternating current equivalent circuit of FIG. 8A has a resistance value of $8R_b$ by a calculating method of a resistance value according to a serial resistor connection. When a control signal of (0, 0, . . . , 1) is inputted to the programmable compensation circuit 335, a resistance value of the programmable compensation circuit becomes $8R_b$.

Figure 8D:
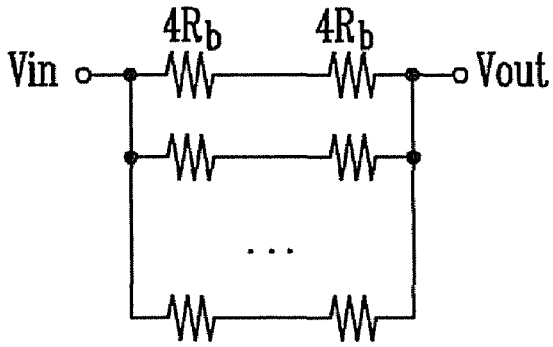

In the same manner, when the control signal (D8, D7, . . . , D1) is (1, 1, . . . , 1), namely, when eight switches M1, M2, . . . , M8 are turned-on, the alternating current equivalent circuit of FIG. 8A is expressed by an alternating current equivalent circuit as shown in FIG. 8D. The alternating current equivalent circuit of FIG. 8A has a resistance value of $R_b$ by a calculating method of a resistance value according to serial and parallel resistor connections. When the control signal of (1, 1, . . . , 1) is inputted to the programmable compensation circuit 335, a resistance value of the programmable compensation circuit becomes $R_b$.

As mentioned earlier, in the programmable compensation circuit 335, since a resistance value is adjusted according to an input control signal of n bits, as illustrated in equation 3, the resistance value can be controlled so that the parallel composite impedance $Z_{TN}$ is equal to $\overline{Z_{diff}}$. In this case, a reflection coefficient becomes zero, removing a reflection loss of a signal.

As explained above, the programmable compensation circuit 335 is connected to a termination resistor $R_t$ included in each data driving circuit 332. Accordingly, an exact impedance matching is embodied with a differential impedance value by the first and second wirings W1 and W2, which are coupled to the data driving circuit 332. Accordingly, the image signals DATA [+,−] applied through the first and second wirings W1 and W2 are reflected, the image signals DATA [+,−], a part of which is lost or distorted by a reflecting wave, can prevent an electro magnetic interference (EMI) applied to the data driving circuits 332. Accordingly, since the image signals DATA [+,−] having a stable wave from the controller 310 are easily applied to the data driving circuit 332, deterioration of image quality of the flat panel display can be prevented.

According to aspects of the present invention, a programmable compensation circuit in a flat panel display using a signal transmission method for transmitting a differential signal may clearly perform an impedance matching without an electro magnetic interference in order to stably transmit a high speed signal by compensating a variation of a differential impedance. The programmable compensation circuit is installed inside the data driving circuit being a receiving end and performs an impedance matching in a differential signal transmission method.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A differential signaling system comprising:

a plurality of pairs of first wirings and a second wirings connected to sending ends and receiving ends as differential signal lines; and a plurality of display data driving circuits connected to the plurality of pairs of first wirings and second wirings, each plurality of display data driving circuits including a programmable compensation circuit connected to a termination resistor in parallel installed between the first and second wirings, the plurality of programmable compensation circuits including a plurality of switches configured to receive an input digital control signal, first n resistors connected between a source electrode of each of the switches and the first wiring, and second n resistors connected between a drain electrode of each of the switches and the second wiring, each bit of the input digital control signal being configured to vary the impedance of the programmable compensation circuit, wherein an impedance of each of the display data driving circuits is adjusted by the corresponding programmable compensation circuit based on the impedance of a corresponding pair of first wiring and second wiring.

2. The differential signaling system according to claim 1, wherein the number of the switches is the number of digital bits of a control signal for controlling the programmable compensation circuit.

3. The differential signaling system according to claim 1, wherein the switch is a transistor having a predetermined minimum distributed gate voltage.

4. The differential signaling system according to claim 1, wherein resistances of the first n resistors and the second n resistors have the same value.

5. The differential signaling system according to claim 4, wherein the resistance of the first resistors and the resistance of the second resistors is $(N/M)R_b$, where $R_b$ represents a resistance value of a resistor included in the programmable compensation circuit, N is a digital control signal bit number inputted to the programmable compensation circuit, and M is a logic high bit number of an input digital control signal.

6. The differential signaling system according to claim 4, wherein M is equal to 8 and N is equal to 2.

7. A differential signaling system comprising:

a display panel having a plurality of data wirings and gate wirings arranged to intersect each other;

a controller to receive an image signal, to generate a control signal, and to output the image signal through first and second wirings as a differential signal line;

a gate driver to receive the control signal from the controller and to apply a scan signal to the gate wirings; and a plurality of display data driving circuits, each including a programmable compensation circuit connected to a terminal resistor in parallel installed between the first and second wirings, the programmable compensation circuits configured to automatically control an impedance value of the corresponding display data driving circuit based on a differential impedance value of the corresponding differential signal line, each of the display data driving circuits including a data driver to receive the image signal and/or the control signal from the controller through the first and second wirings and to apply the image signal to the data wirings;

wherein the programmable compensation circuits each include a plurality of switches to receive each bit of an input digital control signal, each bit of the input digital control signal being configured to vary the impedance of the programmable compensation circuit, first n resistors connected between a source electrode of each of the switches and the first wiring; and second n resistors connected between a drain electrode of each of the switches and the second wiring.

8. The differential signaling system according to claim 7, wherein the number of the switches is the number of digital bits of a control signal for controlling the programmable compensation circuit.

9. The differential signaling system according to claim 7, wherein the switches are transistors having a predetermined minimum distributed gate voltage.

10. The differential signaling system as claimed in claim 7, wherein resistances of the first n resistors and the second n resistors have the same value.

11. The differential signaling system as claimed in claim 10, wherein the resistance of the first resistors and the resistance of the second resistors is $(N/M)R_b$, wherein $R_b$ represents a resistance value of a resistor included in the programmable compensation circuit, N is a digital control signal bit number inputted to the programmable compensation circuit, and M is a logic high bit number of an input digital control signal.

12. The differential signaling system as claimed in claim 10, wherein M is equal to 8 and N is equal to 2.

13. A flat panel display comprising:

a display panel having data wirings and gate wirings arranged so as to intersect;

a controller to receive an input signal, to generate a control signal, and to output the control signal and the input signal to the display panel so as to display an image;

a gate driver to receive the control signal from the controller and to apply a scan signal to the gate wirings; and a plurality of display data driving circuits connected in parallel and configured to receive the image signal and/or the control signal from the controller via first and second wirings and to apply the image signal to the data wirings;

wherein each of the plurality of display data driving circuits includes a programmable compensation circuit to dynamically adjust an impedance of the display data driving circuit so as to match a differential impedance of the controller, wherein each of the programmable compensation circuits comprises a plurality of switches to receive each bit of the control signal, each bit of the input digital control signal being configured to vary the impedance of the programmable compensation circuit, wherein an impedance of each of the display data driving circuits is adjusted by the corresponding programmable compensation circuit based on the impedance of a corresponding pair of first wiring and second wiring.

14. The flat panel display according to claim 13, wherein each of the programmable compensation circuits comprises:

a plurality of first resistors connected between a source electrode of each of the plurality of switches and the first wiring; and a plurality of second resistors connected between a drain electrode of each of the switches and the second wiring.

15. The flat panel display according to claim 14, wherein each switch is a transistor having a predetermined minimum distributed gate voltage.

16. The flat panel display according to claim 14, wherein the number of switches is a number of bits of a control signal to control the programmable compensation circuit.

17. The flat panel display according to claim 14, wherein a resistance of the first resistors is the same as a resistance of the second resistors.

18. The flat panel display according to claim 17, wherein the resistance of the first resistors and the resistance of the second resistors is $(N/M)R_b$, wherein $R_b$ represents a resistance value of a resistor included in the programmable compensation circuit, N is a number of bits of the control signal to control the programmable compensation circuit, and M is a logic high bit number of the control signal to control the programmable compensation circuit.

19. The flat panel display according to claim 18, wherein M is 8 and N is 2.

20. The flat panel display according to claim 13, wherein the display data driving circuits each comprise a termination resistor connecting the first and second wirings.

21. The flat panel display according to claim 13, wherein the programmable compensation circuit compensates for variations in the differential impedance of the controller.

* * * * *